US006607601B1

(12) United States Patent
Scholzig et al.

(10) Patent No.: US 6,607,601 B1
(45) Date of Patent: Aug. 19, 2003

(54) DEVICE FOR TEMPERING COATINGS

(75) Inventors: Jurgen Scholzig, Mainz-Finthen (DE); Hans-Georg Eitel, Bad Homburg (DE)

(73) Assignee: MAN Roland Druckmaschinen AG (DE)

( * ) Notice: Subject to any disclaimer, the term of this patent is extended or adjusted under 35 U.S.C. 154(b) by 0 days.

(21) Appl. No.: 10/049,138

(22) PCT Filed: Jun. 30, 2000

(86) PCT No.: PCT/EP00/06130

§ 371 (c)(1),
(2), (4) Date: Jun. 20, 2002

(87) PCT Pub. No.: WO01/10569

PCT Pub. Date: Feb. 15, 2001

(51) Int. Cl.[7] ..... B05C 1/02

(52) U.S. Cl. ..... 118/667; 118/46; 118/203; 118/249; 118/261; 118/262; 101/423; 101/425; 101/488

(58) Field of Search ..... 118/666, 667, 118/46, 70, 203, 249, 261, 262; 101/423, 425, 487, 488, 212, 153–157, 167; 427/428

(56) References Cited

U.S. PATENT DOCUMENTS 3,741,115 A * 6/1973 Keller ..... 101/48
4,395,968 A 8/1983 Wahnschaff et al.
4,879,951 A * 11/1989 Yoshida et al. ..... 101/363
5,180,612 A * 1/1993 Rendell ..... 427/372.2
5,367,982 A * 11/1994 DeMoore et al. ..... 118/46
5,671,678 A * 9/1997 Bolte et al. ..... 101/491
5,810,927 A * 9/1998 Ayres et al. ..... 118/667

FOREIGN PATENT DOCUMENTS

FR 2 275 800 1/1976

* cited by examiner

*Primary Examiner*—Laura Edwards
(74) *Attorney, Agent, or Firm*—Leydig, Voit & Mayer, Ltd.

(57) ABSTRACT

A coating system for supplying a coating medium to sheet material in a printing press. The coating system includes a tempering system operable for influencing the temperature of both a coating medium processed through the applicator system and rinsing mediums supplied to the applicator system for cleaning the system. The tempering system includes and intermediate container connected to the metering system of the applicator system, a first storage container connected to the intermediate container for containing a stored quantity of coating medium, and a second storage or discharge container connected to the intermediate container for a rinsing medium. The intermediate container includes a heat exchanger such that upon selected connection of either the first or second storage containers to the intermediate container, the cleaning medium or the rinsing medium can be individually tempered for optimum processing.

8 Claims, 2 Drawing Sheets

DEVICE FOR TEMPERING COATINGS

FIELD OF THE INVENTION

The invention relates to a device and method for tempering coating mediums used in printing machines.

BACKGROUND OF THE INVENTION

In applicator systems for printing presses, e.g., in coating systems, it is known to regulate the viscosity of the coating medium by means of tempering control. This can be used to regulate the processibility of coating media for different types of media and for different methods for application. This can expand the processing range of such an applicator system.

A known device for coating surfaces in a printing process is disclosed in U.S. Pat. No. 5,520,739 A. This reference indicates that a coating composition for different systems can be supplied from a single storage container for the feeding of coating compositions to printing processes. Each device for supplying the coating composition is described as a reactor vessel, in which the temperature, and thus also the viscosity, of the coating composition can be influenced. For this purpose, there is a heat exchanger and a temperature sensor, as well as a viscometer for determining the viscosity of the coating composition, in the reactor vessel.

The described device has the disadvantage that the coating composition can only be affected or controlled before the actual printing process or coating process. On the way between the reactor vessel and the printing process, however the physical properties of the coating composition can change again.

Another disadvantage of the above described device is that not all of the processing sequences can be affected by the processing sequences of temperature control. It commonly is necessary for there to be processing sequences for the rinsing or cleaning of the applicator system and the elements contained therein that transport the coating composition in order to prevent permanent contamination through hardening of the coating composition. Here it is also advantageous to control the temperature of the cleaning process. This is not possible with the described device.

OBJECTS AND SUMMARY OF THE INVENTION

The objective of the invention is to influence the tempering control of a coating medium near the printing process and also to provide means that can support the cleaning processes also by means of tempering mechanisms.

In carrying out the invention, it is advantageous that the applicator system be associated with a container that stores the coating medium and that can provide temperature control. This container can supply, in a particularly advantageous way, both coating medium and also a rinsing medium used for cleaning. By feeding the rinsing medium into the intermediate container, the rinsing medium can also be adjusted to a temperature suitable for the cleaning process. Here, the intermediate container is separated in a suitable way from the containers for supplying the coating medium. Through the indicated arrangement, it is guaranteed that all elements in contact with the coating medium can be adequately cleaned at any time.

The effect of improved cleaning also can be achieved in a further advantageous arrangement by means of tempering elements for guiding and metering the coating medium.

Other objects and advantages of the invention will become apparent upon reading the following detailed description and upon reference to the drawings, in which:

Figure 1:
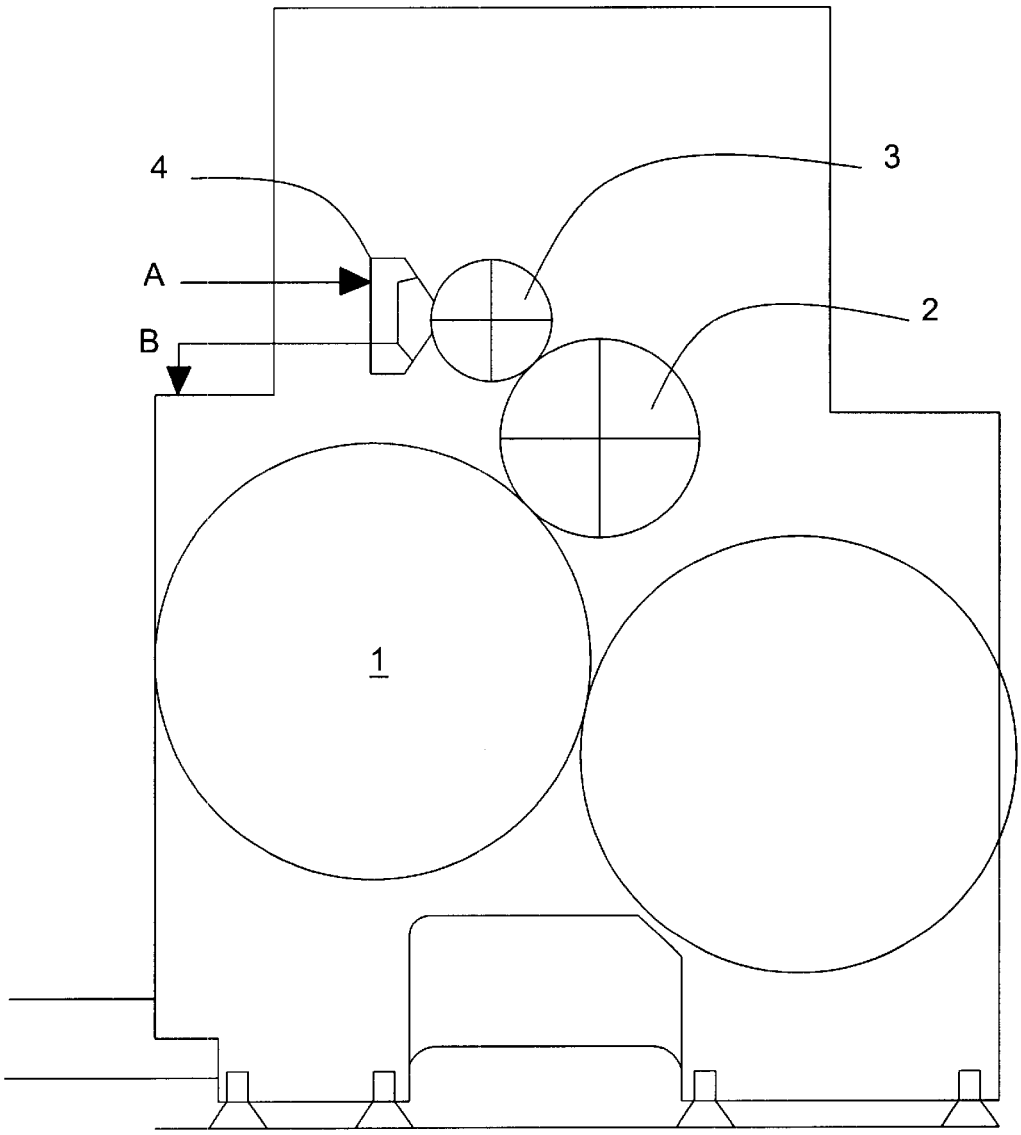
FIG. 1 is a side elevational view of a printing machine having an applicator system with a medium feed device in accordance with the invention.
Figure 2A:
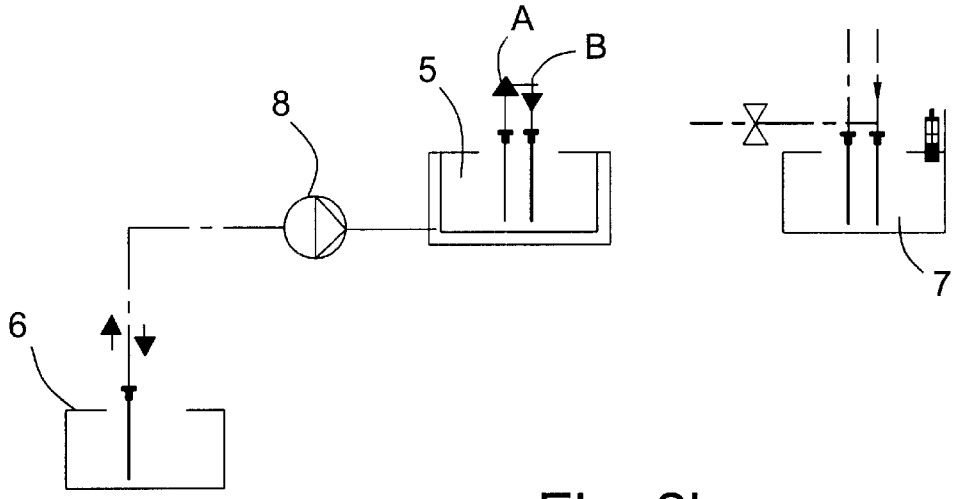
FIGS. 2*a*–2*c* are schematic depictions of the illustrated medium feed device during normal and rinsing operations.
Figure 2B:
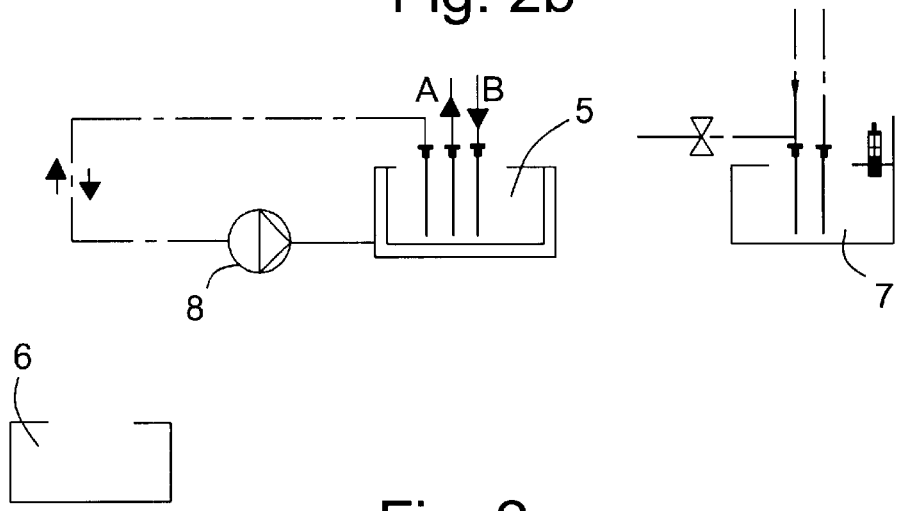
Figure 2C:
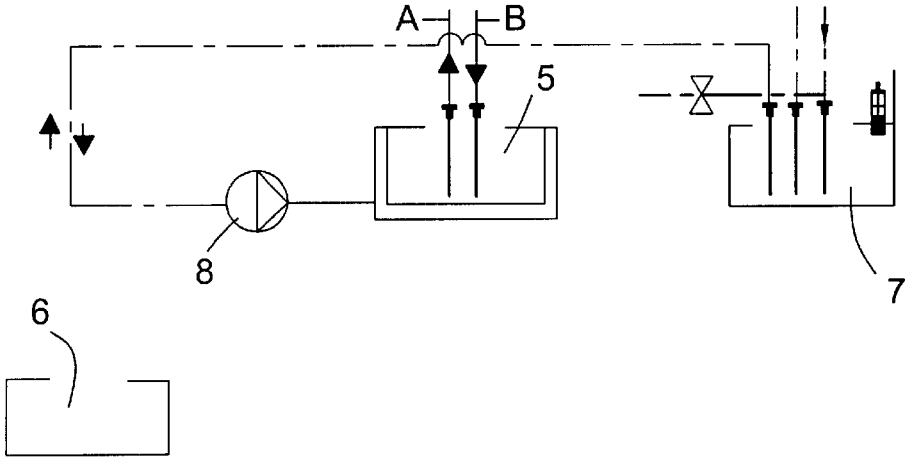

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE PREFERRED EMBODIMENT

Referring now more particularly to the drawings, there is shown an illustrative printing machine having a coating medium applicator system in accordance with the invention. The applicator system includes a printing cylinder 1 for guiding a sheet to be coated, a form cylinder 2 for transferring a layer of the coating medium to the sheet to be printed, and a metering system 5 for generating the coating. In this case, the metering system 5 comprises an applicator roller in the form of as a screen roller 3 having uniformly arranged cups about the periphery for transport of the coating medium. A chamber wiper 4 associated with the screen roller has two wipers, which together with the body of the chamber wiper, define a space for feeding the coating medium. The chamber wiper 4 is set with its two wipers against the screen roller 3 and transfers the coating medium into the recesses of the screen roller 3, with the coating medium being supplied to the chamber wiper by means of a pump. The coating medium is released when the screen roller 3 rolls onto the surface of the form cylinder 2, which has a printing form attached thereto. The printing form can be a uniform surface that coats the entire printing area of a printing sheet, or it can be adopted for coating only for parts of the printing sheet.

The coating medium is fed to the chamber wiper 4 by means of feed lines A and it is led away from the chamber wiper again by means of feed lines B. The feed lines A and B are connected to the medium feed system which includes the feed and suction pumps.

In accordance with the invention, a tempering system It will be appreciated that tempering of the coating medium in the intermediate container, or downstream thereof in the path of travel to the form cylinder, enables the most reliable and efficient processing of the coating medium. It also will be understood that suitable lines and valving systems may be provided for the connections between the components of the system.

In keeping with the invention, a discharge container 7 is connected to the intermediate container 6 on a side opposite the storage container 6. For cleaning the coating medium system, a rinsing medium can be fed between container 7 and the intermediate container 5. According to the particular coating medium to be processed, the temperature of the rinsing medium, therefore, also can be selectively set, i.e. to a different temperature than the coating medium, for enhanced cleaning. In this way, both the feeding of the coating medium by the secondary-metering pump 8 and also the entire coating medium cycle can be cleaned in an optimum way and in the shortest possible time. The secondary-metering pump 8 can even be used during cleaning for evacuating the rinsing medium.

Thus, in the above arrangement, the intermediate container 5 is integrated into the coating medium cycle and the rinsing cycle as a tempering container. The intermediate container 5 is a stand-alone exchangeable element and can be used for heating or cooling depending on its function. The advantage of an intermediate container 5, among other things, is that it does not act as a flow heat exchanger. Flow heat exchangers typically must be operated with great energy consumption due to the short residence time of the tempering medium and they offer insufficient or extremely limited cleaning possibilities.

It can be seen that the intermediate container 5 can be effectively used as a storage container for printing applications. Then, after filling the intermediate container 5, the connection to the storage container 6 is interrupted and the secondary-metering pump 8 pumps the coating medium just in a circulating operation for maintaining the consistency. This process can also be used at the end of printing applications. Here, the supply of the coating medium from the storage container 6 to the intermediate container 5 preferably is blocked so that the remaining amount of coating medium in the intermediate container 5 is sufficient to reliably finish the printing application. This return of coating medium into the storage container 6 and minimizes time for cleaning the system.

For enabling uniform processing of a wide range of coating mediums, other, additional temperature-control devices can be provided in the applicator system. In the region of the chamber wiper 4, a heat-exchanger device of a known type can be used in the wiper body or attached to it. In this way, the wiper body, including the wiper connected to this body, can be set to a certain temperature that, in turn, is transferred to the coating medium in the chamber wiper 4. Furthermore, the screen roller 3 can be provided with a tempering device known for inking systems of rotary printing presses. For this purpose, the screen roller 3 can be formed with a series of flow channels that are each filled with tempering fluid.

Still another alternative tempering approach consists of providing the form cylinder 2 with a tempering device like those known for the screen roller 3.

Alternatively, when coating by means of a chamber wiper and a screen roller, a roller coating system also can be provided. By arranging the tempering devices on both rollers, or alternatively on only one of the two rollers, the temperature of the coating medium to be transferred can be precisely adjusted.

The foregoing system can be expanded by also providing, in roller lacquer systems or roller coating units, a temperable, optional lacquer tank, which is comparable to the chamber wiper or the lacquer supply on a so-called crushing roller system, e.g., a lacquer blade immersed in a lacquer storage tank between the two rollers forming the crushing roller system. Furthermore, cleaning fluids that are applied to the surfaces in contact with the coating medium can be tempered, preferably heated, in a similar way.

What is claimed is:

1. A coating system for supplying a coating medium to sheet material during sheet transfer comprising a coating medium applicator system including a form cylinder (2) for applying coating medium to sheet material and a metering system (9) for metering and transferring a predetermined amount of coating medium to one of the form cylinder (2) or sheet material attached to the form cylinder (2); a sensing device for detecting the temperature of the coating medium; a tempering system for influencing the temperature of the coating medium transferred to said form cylinder; an intermediate container (5) connected to said metering system (9) for supplying coating medium to said metering system, a coating medium storage container (6) connectable to said intermediate container (5) for supplying coating medium to said intermediate container; a discharge storage container (7) for a rinsing medium connected to the intermediate container whereby a rinsing medium may be supplied to the intermediate container and then to the applicator system for cleaning the applicator system; and said tempering system including a heat exchanger for influencing the temperature of either the coating medium or the rinsing medium supplied to the applicator system from the intermediate container.

2. The coating system of claim 1 in which said tempering system heat exchanger is disposed in said intermediate container.

3. The coating system of claim 1 including at least one connection between the storage container (6) and the intermediate container (5) that can be selectively switched off, and at least one connection between the intermediate container (5) and the discharge container (7) that can be selectively switch off.

4. The coating system of claim 3 in which said at least one connection between the storage container (6) and said intermediate container (5) includes a feed pump.

5. The coating system of claim 1 in which said metering system (9) comprises an applicator roller (3) and a metering device (4) associated with the applicator roller (3).

6. A method of supplying coating and cleaning mediums to an applicator system of a printing press having an applicator roller and a metering system comprising the steps of providing a first intermediate container for supplying coating medium to the metering system, providing a first storage container for supplying coating medium to the intermediate container, providing a second storage container for containing a rinsing medium, supplying the coating medium from the first container to the intermediate container and then to the metering system, tempering the coating medium by influencing the temperature thereof at a location between the intermediate container and the metering system, interrupting the supply of coating medium from the storage container to the intermediate container and supplying a rinsing medium to the intermediate container and then to the metering system for cleaning the applicator system, and tempering the rinsing medium influencing at said location between the intermediate container and the metering system.

7. The method of claim 6 including tempering the coating medium and rinsing medium by influencing the temperature thereof while in the intermediate container.

8. The method of claim 7 including interrupting the supply of coating medium from the first storage container to the intermediate container circulating the coating medium in the intermediate container.

* * * * *